US005138309A

United States Patent [19]

Gonzalez et al.

[11] Patent Number: 5,138,309

[45] Date of Patent: Aug. 11, 1992

[54] ELECTRONIC SWITCH MATRIX FOR A VIDEO DISPLAY SYSTEM

[75] Inventors: Walter Gonzalez, Rancho Palos Verdes; Andrei Szilagyi, Brentwood, both of Calif.

[73] Assignee: Aura Systems, Inc., El Segundo, Calif.

[21] Appl. No.: 504,125

[22] Filed: Apr. 3, 1990

[51] Int. Cl.[5] ..... G09G 3/34

[52] U.S. Cl. ..... 340/783; 340/766; 340/814; 355/140

[58] Field of Search ..... 340/814, 784, 805, 801, 340/811, 783, 766; 358/66, 231, 27, 59, 241, 236, 140

[56] References Cited

U.S. PATENT DOCUMENTS 4,626,837 12/1986 Priestly ..... 340/723

4,716,403 12/1987 Morozumi ..... 340/703

4,978,952 12/1990 Irwin ..... 358/236

*Primary Examiner*—Alvin E. Oberley

*Assistant Examiner*—Chanh Nguyen

*Attorney, Agent, or Firm*—Anthony T. Cascio

[57] ABSTRACT

An electronic switch matrix for a video projection system has a plurality of switch elements, each of which is associated with a respective one of the display pixels in a MxN array. A first counter, in response to a pixel clock and the horizontal sync signal, provides the column timing for activating the switch elements. Similarly, a second counter, in response to a row block and the vertical sync signal, provides the row timing for activating the switch elements. A switch element activated simultaneously by each counter then couples the luminance signal to a video display circuit element for developing the appropriate pixel intensity.

10 Claims, 4 Drawing Sheets

FIG. 1
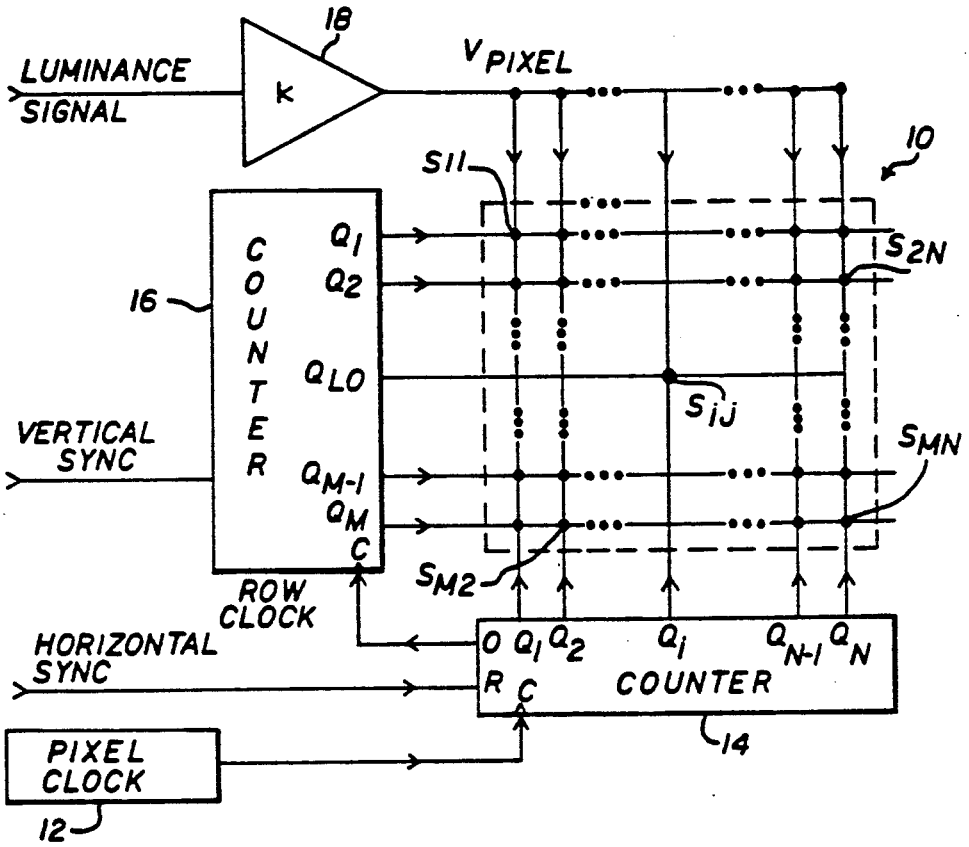
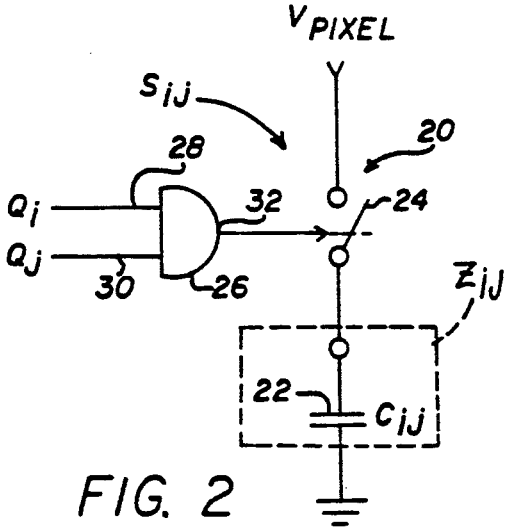
FIG. 2
FIG. 3
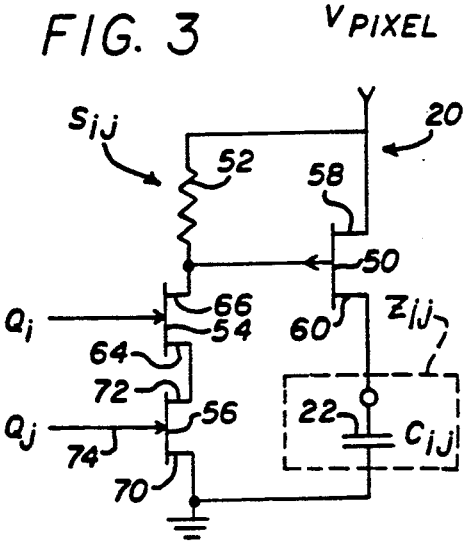

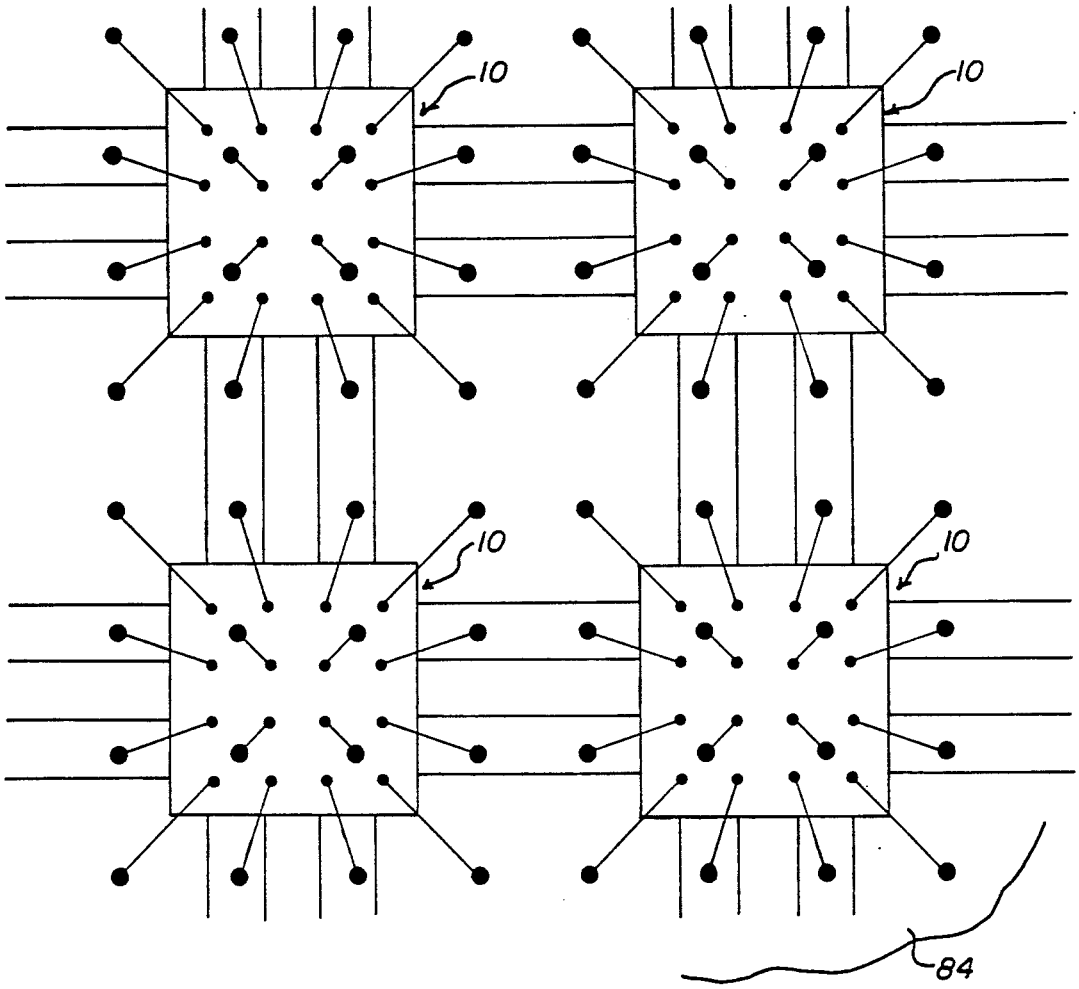
FIG. 5
FIG. 6
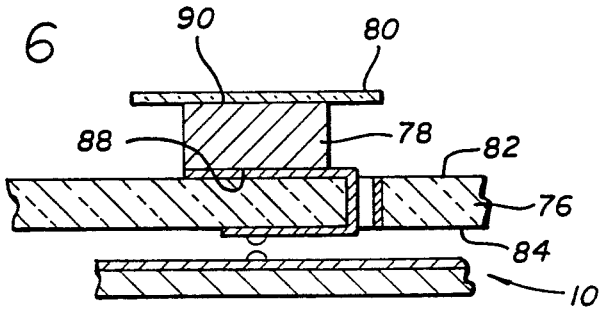

ELECTRONIC SWITCH MATRIX FOR A VIDEO DISPLAY SYSTEM

RELATED APPLICATION DATA

The following disclosure is related to the disclosure of the commonly owned application, Ser. No. 07/478,139, filed Feb. 9, 1990.

FIELD OF INVENTION

The present invention relates generally to electronic switching matrices and more particularly to a novel switch matrix controlling the scanning of pixels in a video display system.

BACKGROUND OF INVENTION

Video display systems generally display an image as an M×N array of pixels. In one particular class of video display systems, known as optical projection systems, one or more beams of light are modulated in accordance with electrical signals received from an electronic controller. In the case of a single modulated beam, the beam is scanned horizontally in successive lines on a screen to develop the image. With multiple modulated beams, each beam may be used to scan one row, respectively, in the image. The multiple beams would simultaneously traverse the screen in a pattern called "push trace" scanning. During the horizontal scanning, the beam intensity in each beam is modulated for each column of pixels to form the image.

A multiple beam system is disclosed in co-pending, commonly owned application, Ser. No. 429,987, filed Nov. 1, 1989, entitled "Unique Modulation Television." The disclosed multiple beam system includes a M×1 mirror array wherein M is equal to the number of horizontal lines in the pixel array. In one of the embodiments, the mirrors in the array are pivotally mounted along one of their edges to a base plate. Mounted to an opposite edge of each mirror and also to the base plate is a piezoelectric crystal, such that there is one piezoelectric crystal for each mirror. The mirror array is uniformly illuminated and the reflected light beam from each mirror is incident upon a slit. By applying electrical signals to the piezoelectric crystals, the position of each of the mirrors is altered, thereby causing a slight deviation in the path of each of the reflected beams. As the path of each beam is changed, the amount of light from each beam which passes through the slit varies, thereby modulating the intensity of the beam. Each modulated beam is then incident on a rotating polygonal mirror which horizontally sweeps each of the beams across a screen. As the beams are being horizontally swept, the electrical signals to each of the piezoelectric crystals may be changing to vary the intensity for each column of pixels in the resultant displayed image. As disclosed in this prior filed application, the electrical signals are exemplarily provided by clocking data from a bit mapped memory, wherein the data clock is synchronous with the scan rate in the pixel array.

The rotating mirror which provides the horizontal sweep may be eliminated by providing an M×N mirror array. The reflected beam from each mirror is used to develop each pixel in the displayed M×N image. An example of a video display system using an M×N mirror array is disclosed in co-pending commonly owned application, Ser. No. 448,748, filed Dec. 11, 1989, entitled "Unique Modulation Television." Similarly to the system disclosed in the above mentioned prior filed application, each beam is modulated by applying an electric signal to each piezoelectric crystal under each mirror.

In each of the above mentioned prior filed applications, several types of mirror arrays are disclosed. Although it is within one of ordinary skill in the art to develop the appropriate electrical signals for application to the piezoelectric crystals, it would be desirable to provide a switching matrix which is easily integratable, both electronically and structurally, with the mirror array.

SUMMARY OF THE INVENTION

In the following specification, an electronic switch matrix for a video display system is disclosed. The video display system develops an M×N array of pixels from a composite video signal and has a plurality of circuit elements, $Z_{ij}$. Each of the circuit elements, $Z_{ij}$, controls the intensity of a respective one of the pixels, wherein $1 \leqq i \leqq M$ and $1 \leqq j \leqq N$. As is known, the composite video signal includes a luminance signal, a horizontal sync signal and a vertical sync signal.

According to the present invention, the electronic switch matrix includes a pixel clock, a first counter, a second counter and a plurality of switch cells, $S_{ij}$. The pixel clock develops a pixel clock signal having a plurality of first clock pulses. Each of the first clock pulses occurs at a rate commensurate with the scan rate of the pixels.

The first counter has a clock input, a reset input, at least N first outputs and a second output. The clock input has the pixel clock signal applied thereto. The reset input is adapted to have the horizontal sync signal applied thereto. A $j^{th}$ one of the first outputs is adapted to be coupled electrically to a respective one of the switch cells, $S_{ij}$. The $j^{th}$ one of the first outputs has a first logic state upon occurrence of a $j^{th}$ clock pulse of the first clock pulse subsequent to a sync pulse of the horizontal sync signal. Each of the other first outputs has a second logic state at the $j^{th}$ clock pulse. The second output develops a second clock signal having a plurality of second clock pulses. Each of the second clock pulses occurs when a first one ($j=1$) of the first outputs is at the first logic state.

The second counter has a clock input, a reset input and at least M outputs. The clock input of the second counter is electrically coupled to the second output of the first counter to apply the second clock signal thereto. The reset input of the second counter is adapted to have the vertical sync signal applied thereto. An $i^{th}$ one of the M outputs is adapted to be coupled electrically to a respective one of the switch cells $S_{ij}$. The $i^{th}$ one of the M outputs has the first logic state upon occurrence of an $i^{th}$ clock pulse of the second clock pulses subsequent to a sync pulse of the vertical sync signal. Each of the other M outputs has a second logic state at the $i^{th}$ clock pulse.

Each of the switch cells $S_{ij}$, is adapted to apply the luminance signal to a respective one of the circuit elements, $Z_{ij}$. The luminance signal is so applied when each of the $i^{th}$ one of the M outputs and the $j^{th}$ one of the N outputs has the first logic state.

In one aspect of the present invention, the circuit elements $Z_{ij}$, may be modelled by the capacitance, $C_{ij}$, across the piezoelectric materials in the mirror arrays disclosed in the above-mentioned copending prior filed applications. The capacitance is due to the metal electrodes on opposite faces of the piezoelectric material and to the dielectric constant of the material. However, it is a feature of the present invention that the electronic switch matrix is adaptable to other types of video display systems, such as the liquid crystal video displays. The circuit element, $Z_{ij}$, instead of being a piezoelectric element, will be the pixel in each of the liquid crystal displays.

An advantage of the present invention is that it is readily constructable on an integrated or hybrid circuit on a first substrate which may then in turn be integrated with a second substrate for either a mirror array or liquid crystal display. A further advantage of the present invention is that only a single high voltage amplifier is required to drive the matrix pixels, rather than the multiplicity of such amplifiers required in conventional video projection systems.

These and other objects, advantages and features of the present invention will become apparent to those skilled in the art from a study of the following description of an exemplary preferred embodiment when read in conjunction with the attached drawings and appended claims.

BRIEF DESCRIPTION OF THE DRAWINGS

FIG. 1 is a block diagram of an electronic switch matrix having a plurality of switch cells;

FIG. 2 is a functional circuit diagram of one switch cell;

FIG. 3 is a more detailed circuit diagram for each switch cell;

FIGS. 5 and 6 illustrate an exemplary use of the switch matrix integrated with a mirror array.

DESCRIPTION OF AN EXEMPLARY PREFERRED EMBODIMENT

Figure 4:
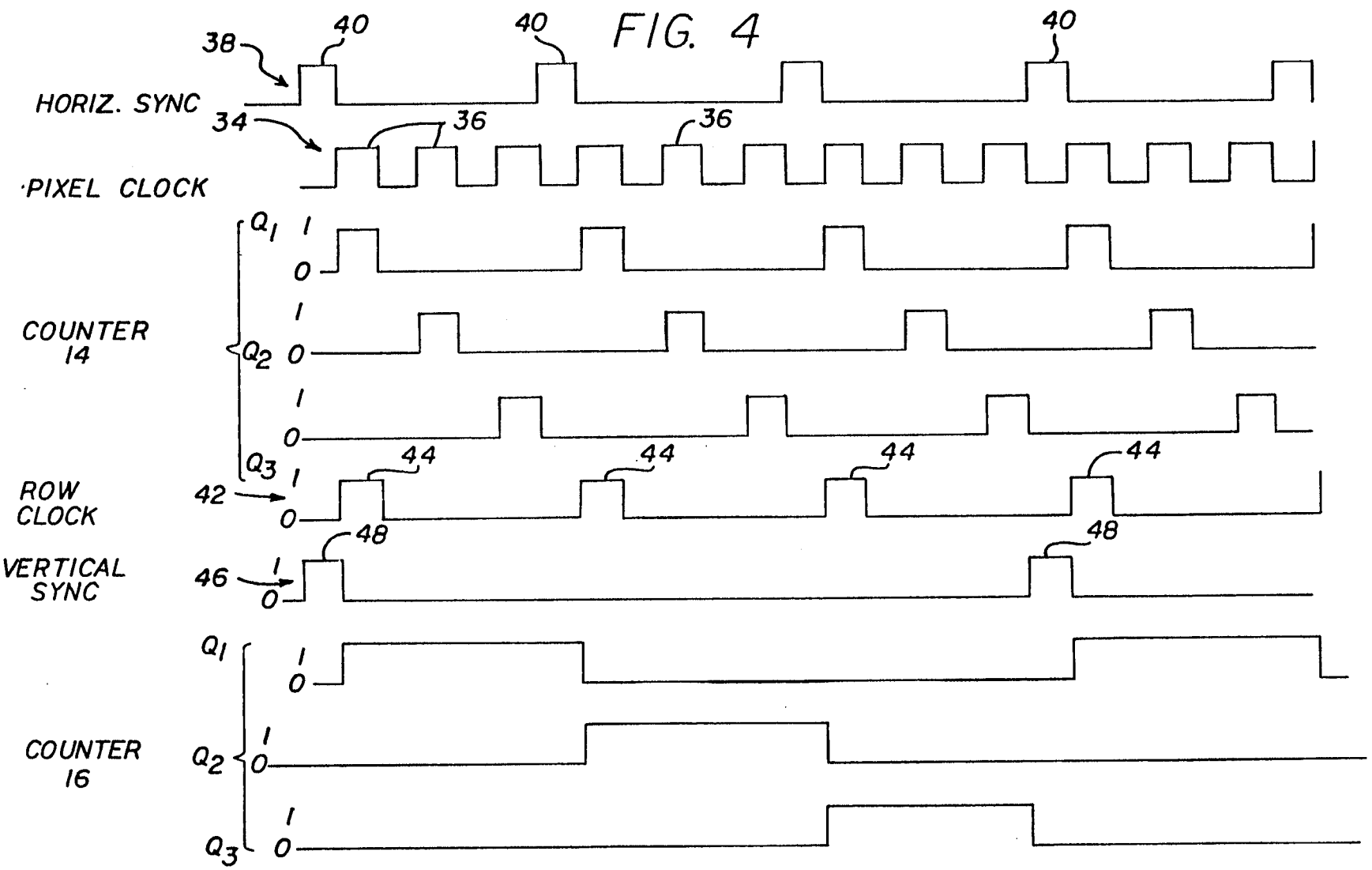
FIG. 4 is a timing diagram useful in explaining the operation of the switch matrix of FIG. 1.

Referring now to FIG. 1, there is shown an electronic switch matrix 10 for a video display system (not shown). A video display system typically develops an $M \times N$ array of pixels from a composite video signal. Typically, such a system has a plurality of circuit elements, $Z_{ij}$, where $1 \leqq i \leqq M$ and $1 \leqq j \leqq N$. As is known in the art, each of the circuit elements, $Z_{ij}$, controls the intensity of a respective one of the pixels. The circuit elements, $Z_{ij}$, will, for purposes of the description hereinbelow, be exemplarily described with particular reference to the inherent capacitance, $C_{ij}$, existing across piezoelectric crystals in the mirror arrays as disclosed in the above mentioned application filed concurrently herewith, and operable as disclosed in each of the above mentioned prior filed applications, all of which are incorporated herein by reference.

Furthermore, the present disclosure will also be made with reference to a composite video signal. As is known, a composite video signal includes a luminance signal, a horizontal sync signal and a vertical sync signal. It is to be noted that the present disclosure is not limited to the use of the composite video but may also be digital video signal such as developed by a bit mapped memory. The interchangeability and the requirements for using each type of video signal is well known in the art and need not be further described herein.

With particular reference now to FIG. 1, the switch matrix 10 includes a pixel clock 12, a first counter 14, a second counter 16, and a plurality of switch cells, $S_{ij}$. The first counter 16 has a clock input, C, a reset input, R, at least N first outputs, $Q_1$–$Q_N$, and a second output, O. The second counter 16 has a clock input, C, a reset input, R, and at least M outputs, $Q_1$–$Q_M$.

The clock input, C, of the first counter 14 is electrically coupled to the pixel clock 12. The clock input, C, of the second counter 16 is electrically coupled to the second output, O, of the first counter 14. An $i^{th}$ one, $Q_i$, of the M outputs, $Q_1$–$Q_M$, of the second counter 16 is electrically coupled to a respective one of the switch cells, $S_{ij}$. Similarly, a $j^{th}$ one, $Q_j$, of the N outputs, $Q_1$–$Q_N$, of the first counter is coupled electrically to a respective one of the switch cells, $S_{ij}$. For example, the output $Q_1$ of the first counter 14 and the output $Q_1$ of the second counter 16 are each electrically coupled to the switch cell, $S_{11}$, as best seen in FIG. 1. Other exemplary connections, as above described, are also shown in FIG. 1.

In certain applications, which will be described in greater detail hereinbelow, the switch matrix 10 may also include a high voltage, high speed, linear amplifier 18. The amplifier 18 has an input and an output electrically coupled to each of the switch cells, $S_{ij}$. Generally, the amplifier gain is selected in accordance with the impedance of each of the circuit elements, $Z_{ij}$, of the video display system. For example, when the switch matrix 10 is being used with the piezoelectric activated mirror array as disclosed in the above referenced applications, the circuit element, $Z_{ij}$, is best represented by an high impedance capacitance, $C_{ij}$. The amplifier 18 would preferably produce an output voltage applicable to the chosen modulation technique. For an exemplary piezoelectric mirror array, a pixel voltage, $V_{pixel}$, between 0 v and 500 v from the conventional voltage level of the luminance signal would be required.

With further reference to FIG. 2, there is shown a functional equivalent circuit 20 representing one switch cell, $S_{ij}$. In the circuit 20 shown in FIG. 2, the circuit element, $Z_{ij}$, of the video display system is represented as a capacitor 22 having a capacitance, $C_{ij}$. The equivalent circuit 20 for each of the switch cells, $S_{ij}$, includes a normally open switch 24 and an AND logic circuit 26.

The switch 24 is electrically coupled between the output of the amplifier 18 (FIG. 1) and a respective capacitor 22 (or circuit elements, $Z_{ij}$). The AND logic circuit 26 has a first input 28 and a second input 30. The first input 28 of the logic circuit 26 is coupled to the $i^{th}$ one, $Q_i$, of the M outputs, $Q_1$–$Q_M$. Similarly, the second input 30 of the logic circuit 26 is electrically coupled to the $j^{th}$ one, $Q_j$ of the N outputs, $Q_1$–$Q_N$. As best seen in FIG. 2, the logic circuit 26 further has an output 32 which activates the switch 24.

With further reference to FIG. 4, the operation of the above described apparatus is described. Although the description of FIG. 4 is in reference to a simplified $3 \times 3$ array, it should be obvious to those skilled in the art that the following description is readily adaptable to describe the operation of the generalized $M \times N$ array described above.

The pixel clock 12 develops a first clock signal 34. The first clock signal 34 has a plurality of first clock pulses 36. The first clock pulses 36 occur at a rate commensurate with the electronic scan rate of the pixels. The reset input, R, of the first counter is adapted to have the horizontal sync signal 38 applied thereto. As is well known in the art, the horizontal sync signal 38 has a plurality of horizontal sync pulses 40. Generally, the first counter 14 in response to each of the first clock signal 36 and the horizontal sync signal 38 develops a first logic state at a $j^{th}$ one, $Q_j$, of the first outputs, $Q_1$–$Q_N$, upon the occurrence of a $j^{th}$ clock pulse of the first clock pulses 36 subsequent to a sync pulse 40 of the horizontal sync signal 38. In the simplified timing diagram of FIG. 4, the outputs, $Q_1$, $Q_2$ and $Q_3$ of the first counter 14 respectively develop a binary 1 at the first, second and third one of the first clock pulses 36 following a sync pulse 40. It is noted that whenever one of the outputs, $Q_j$, of the first counter is at a binary 1, all the other outputs of the first counter have a second logic state at the $j^{th}$ clock pulse. The second logic state is a binary 0. In further response to each of the pixel clock signal 34 and the horizontal sync signal 38, the first counter 14 develops a second clock signal 42 at the second output, 0. The second clock signal 42 has a plurality of second clock pulses 44. Each of the second clock pulses 44 occurs when a first one ($j=1$) of the N outputs, $Q_1$–$Q_N$, is at the first logic state, as seen in FIG. 4.

The second clock signal 42 is applied to the clock input, C, of the second counter 16. The reset input, R, of the second counter 16 has the vertical sync signal 46 applied thereto. The vertical sync signal 46 includes a plurality of vertical sync pulses 48. In response to the second clock signal 42 and the vertical sync signal 46, the $i^{th}$ one of the M outputs, $Q_1$–$Q_M$, has the first logic state upon occurrence of an $i^{th}$ clock pulse of the second clock pulses 44 subsequent to each sync pulse 48 of the vertical sync signal 46. Each of the other M outputs, $Q_1$–$Q_M$, has the second logic state at the $i^{th}$ clock pulse. In the simplified timing diagram of FIG. 4, the outputs, $Q_1$, $Q_2$ and $Q_3$ of the second counter 16 respectively develop a binary 1 at the first, second and third one of the second clock pulses 44 following a vertical sync pulse 48.

Referring again to FIG. 2, when each of the $i^{th}$ one of the M outputs, $Q_1$–$Q_M$, and the $j^{th}$ one of the N outputs, $Q_1$–$Q_N$, is at the first logic state or binary 1, the output of the AND gate 32 goes high. The switch 24 for the switch cell, $S_{ij}$, closes to apply the luminance signal to the respective one of the circuit elements, $Z_{ij}$, or as best seen in FIG. 2, the capacitor 22.

With reference to FIG. 3, there is shown a preferred embodiment of the circuit 20 of FIG. 2 for each of the switch cells, $S_{ij}$. The switch cell, $S_{ij}$, of FIG. 3 includes a p-channel MOSFET 50, a resistor 52, a first n-channel MOSFET 54, and a second n-channel MOSFET 56.

The p-channel MOSFET has a source 58, a drain 60, and a gate 62. The source 58 is electrically coupled to the output of the amplifier 18 to have the luminance signal applied thereto. The drain 60 is adapted to be electrically coupled to a respective one of the circuit elements, $Z_{ij}$, and in particular the capacitor 22.

The first n-channel MOSFET 54 has a source 64, a drain 66, and a gate 68. The resistor 52 is electrically coupled in series between the drain 66 of the first n-channel MOSFET 54 and the output of the amplifier 18 to couple resistively the luminance signal to the drain 66 of the first n-channel MOSFET 54. The gate 62 of the p-channel MOSFET 50 is also electrically coupled to the drain 66 of the first n-channel MOSFET 54. The gate 68 of the first n-channel MOSFET 54 is electrically coupled to the $i^{th}$ one, $Q_i$, of the M outputs, $Q_1$–$Q_M$.

The second n-channel MOSFET 56 has a source 70, a drain 72, and a gate 74. The source 70 of the second n-channel MOSFET 56 is coupled to ground potential as best seen in FIG. 3. The drain 72 of the second n-channel MOSFET 56 is electrically coupled to the source 64 of the first n-channel MOSFET 54. The gate 74 of the second n-channel MOSFET 56 is electrically coupled to the $j^{th}$ one, $Q_j$, of the N outputs, $Q_1$–$Q_N$.

In operation, when the $i^{th}$ one, $Q_i$, of the M outputs, $Q_1$–$Q_M$, and the $j^{th}$ one, $Q_j$, of the N outputs, $Q_1$–$Q_N$, each go high to a binary 1, each of the first n-channel MOSFET 54 and the second n-channel MOSFET 56 become conductive, thereby pulling a current through resistor 52. The gate 62 of the p-channel MOSFET 50 goes to a low potential in response to this current. When the potential of the gate 62 goes low, the p-channel MOSFET 50 turns on coupling the luminance signal to the circuit element, $Z_{ij}$, or capacitor 22. In the embodiment where the capacitance, $C_{ij}$, is the capacitance across the piezoelectric crystal, a high voltage could be needed to charge this capacitor. Therefore, the output, $V_{pixel}$, of the amplifier 18 should swing between 0 v and 500 v as hereinabove described. Of course, this requirement for the output voltage, $V_{pixel}$, is not necessary when low voltage pixel elements, $Z_{ij}$ are being used.

With reference to FIGS. 5 and 6, it is shown how the above described switch matrix 10 may be configured to construct a video display system in conjunction with the mirror arrays as described in the above referenced applications. The video display system includes an electrically insulative substrate 76, a plurality of piezoelectric members 78, a plurality of mirrors 80, and the switch matrix 10 as described hereinabove. In FIG. 5, there is shown how four separate $4\times4$ switch matrices 10 can be used to construct an $8\times8$ array. Of course, any size switch matrices 10 can be used, alone or with others, to construct any $M\times N$ sized array.

The substrate 76 has a top surface 82, a bottom surface 84 and an $M\times N$ array of holes 86 between the top surface 82 and bottom surface 84. Each of the piezoelectric members 78 is disposed on the top surface 82 adjacent to a respective one of the holes 86. Each of the piezoelectric members has a first metallized face 88 and a second metallized face 90. However, the metallized faces 88 and 90, as shown in FIG. 6, need not be parallel to surfaces 82 and 84. Each of the mirrors 80 is mounted to a respective one of the piezoelectric members 78.

The integrated circuit electronic switch matrix 10 is mounted to the bottom surface 84. Metal plating 92 is deposited in each of the holes 86 and extends partially onto surfaces 82 and 84 therefrom to connect the first metallized face 88 of each of the piezoelectric members 78 to a metallization 94 on the switch matrix 10 through one of the holes 86 adjacent thereto. FIG. 5 illustrates the interconnections between the switch matrix metallizations 94 and the piezoelectric members 78 through the plated path 92. The second metallized face 90 of each of the piezoelectric members 78 is coupled to ground potential, as described in the above referenced applications.

The switch matrix 10 operates as hereinabove described by switching the luminance signal to the first face of each of the piezoelectric members as hereinabove described. Each of the piezoelectric members 78 in response thereto causes a measured change in orientation of the respective one of the mirrors 80 mounted thereto. Each of the mirrors 80 thereby modulates the light intensity reflected therefrom as described in the above referenced applications. The modulated light intensity from each of the mirrors 80 corresponds to one of the pixels. The substrate 76 may be a ceramic substrate.

Figure 7:
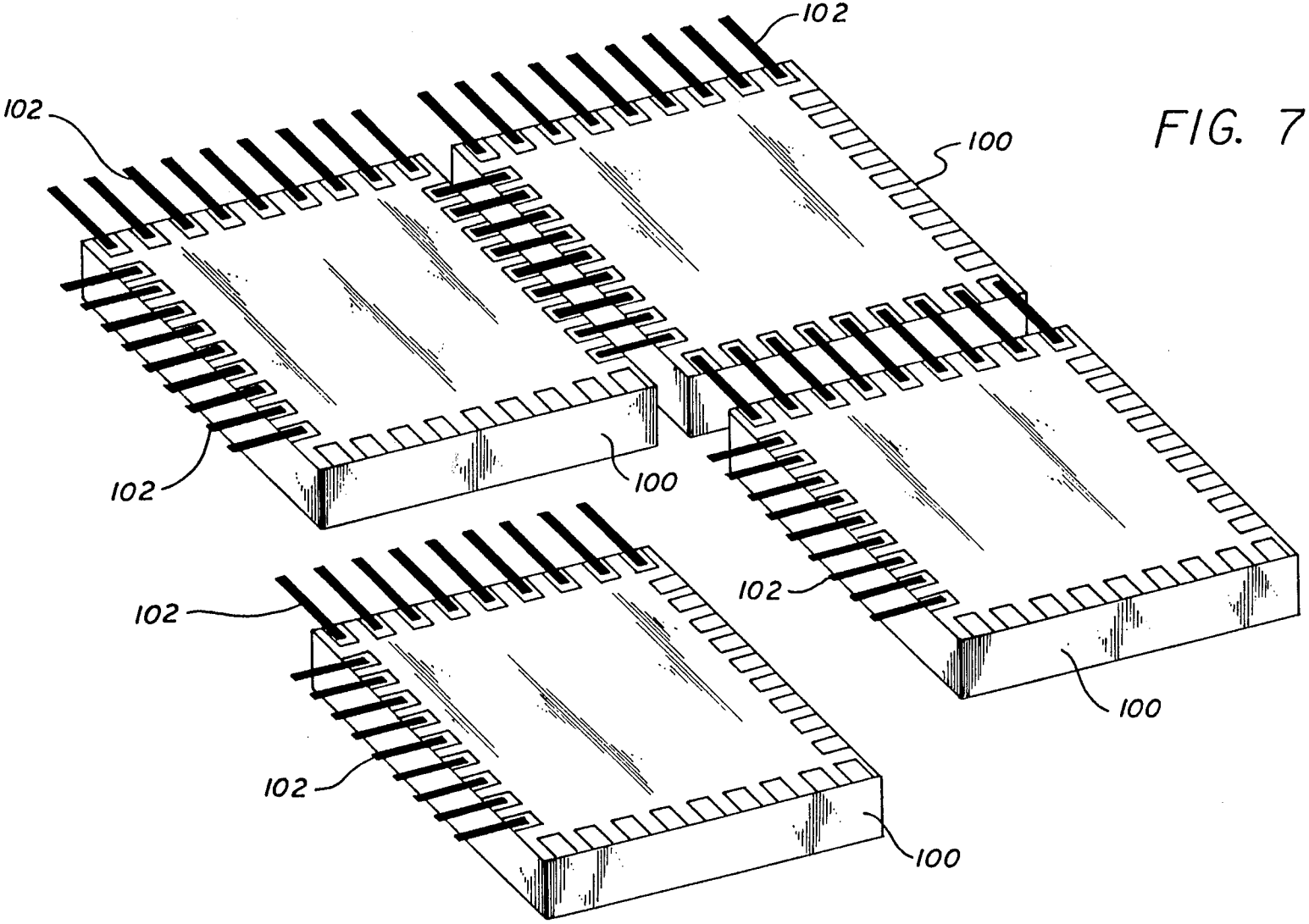
FIG. 7 illustrates individual switch matrices packaged in modular integrated circuits, and assembled to form a larger array.

It is contemplated that the switch matrices of the present invention be further packaged into integrated circuits 100, as shown in FIG. 7. The individual integrated circuits 100 may be further assembled in forming a larger matrix. The integrated circuits 100 of FIG. 7 are exemplarily shown as being 8×8 matrices.

In an exemplary switch matrix formed by assembling a plurality of integrated circuits 100, as shown in FIG. 7, the clock pulses for row and column enabling are passed from the two counters to a first column and first row of switch matrix integrated circuits respectively, and from there to a subsequent such column and row, and so on. The various signals, such as clock pulses and luminance signal, are transmitted between adjacent integrated circuits by metal leads 102, constructed in accordance with the Tape Automated Bonding (TAB) technique commonly known in the art. On the exemplary integrated circuits 100, the metal leads 102 are on one side of the integrated circuit, and the metal plating 92 interconnections to the piezoelectric members 78 are on the other side.

There has been described hereinabove a novel electronic switch matrix particularly adapted for a video display system. Those skilled in the art may now make numerous uses of and modifications to the above described exemplary preferred embodiment of the switch matrix without departing from the inventive concepts disclosed herein. Accordingly, the present invention is to be defined solely by the scope of the following claims.

We claim:

1. An electronic switch matrix for a video display system which develops an M×N array of pixels from a composite video signal, said video display system having a plurality of circuit elements, $Z_{ij}$, wherein each of said circuit elements, $Z_{ij}$, controls the intensity of a respective one of said pixels and further wherein $1 \leqq i \leqq M$ and $1 \leqq j \leqq N$, said composite video signal including a luminance signal, a horizontal sync signal and a vertical sync signal, said switch matrix comprising:

a pixel clock to develop a first clock signal having a plurality of first clock pulses occurring at a rate commensurate with a scan rate of said pixels;

a plurality of switch cells, $S_{ij}$;

a first counter having a clock input, a reset input, at least N first outputs and a second output, said clock input having said clock signal applied thereto, said reset input being adapted to have said horizontal sync signal applied thereto, a $j^{th}$ one of said first outputs being adapted to be coupled electrically to a respective one of said switch cells, $S_{ij}$, said $j^{th}$ one of said first outputs having a first logic state upon occurrence of a $j^{th}$ clock pulse of said first clock pulses subsequent to a sync pulse of said horizontal sync signal, each other of said first outputs having a second logic state at said $j^{th}$ clock pulse, said second output developing a second clock signal having a plurality of second clock pulses, each of said second clock pulses occurring when a first one (j=1) of said first outputs is at said first logic state;

a second counter having a clock input, a reset input and at least M outputs, said clock input of said second counter being electrically coupled to said second output of said first counter to apply said second clock signal thereto, said reset input of said second counter being adapted to have said vertical sync signal applied thereto, an $i^{th}$ one of said M outputs being coupled electrically to a respective one of said switch cells, $S_{ij}$, said $i^{th}$ one of said M outputs having said first logic state upon occurrence of an $i^{th}$ clock pulse of said second clock pulse subsequent to a sync pulse of said vertical sync signal, each other of said M outputs having said second logic state at said $i^{th}$ clock pulse;

each of said switch cells, $S_{ij}$, being adapted to apply said luminance signal to a respective one of said circuit elements, $Z_{ij}$, when each of said $i^{th}$ one of said M outputs and said $j^{th}$ one of said N outputs has said first logic state.

2. An electronic switch matrix as set forth in claim 1 further comprising:

a high voltage, high speed linear amplifier having an input adapted to have said luminance signal applied thereto and an output electrically coupled to each of said switch cells, $S_{ij}$.

3. An electronic switch matrix as set forth in claim 1 wherein each of said switch cells, $S_{ij}$, includes:

a normally open switch adapted to be coupled electrically to said respective one of said circuit elements, $Z_{ij}$; and an AND logic circuit having a first input electrically coupled to said $i^{th}$ one of said M outputs, a second input electrically coupled to said $j^{th}$ one of said N outputs, and an output, said output of said logic circuit normally being at said second logic state and being at said first logic state when each of said $i^{th}$ one of said M outputs and said $j^{th}$ one of said N outputs is at said first logic state, said switch closing in response to said output of said logic circuit being at said first logic state to apply said luminance signal to said respective one of said circuit elements, $Z_{ij}$.

4. An electronic switch matrix as set forth in claim 1 wherein each of said switch cells, $S_{ij}$, includes:

a p-channel MOSFET having a source, a drain and a gate, said source being adapted to have said luminance signal applied thereto, said drain being adapted to be coupled electrically to a respective one of said circuit elements, $Z_{ij}$;

a resistor;

a first n-channel MOSFET having a source, a drain and a gate, said resistor being electrically coupled to said drain of said first n-channel MOSFET to resistively couple said luminance signal to said drain of said first n-channel MOSFET, said gate of said first n-channel MOSFET being electrically coupled to said $i^{th}$ one of said M outputs, said gate of said p-channel MOSFET being electrically coupled to said drain of said first n-channel MOSFET; and a second n-channel MOSFET having a source, a drain and a gate, said drain of said second n-channel MOSFET being electrically coupled to said source of said first n-channel MOSFET, said source of said second n-channel MOSFET being adapted to be coupled to ground potential, said gate of said second n-channel MOSFET being electrically coupled to said $j^{th}$ one of said N outputs.

5. An electronic switch matrix as set forth in claim 1 wherein said first logic state is an electrical signal commensurate with a binary 1 and said second logic state is an electrical signal commensurate with a binary 0.

6. An electronic switch matrix for a video display system which develops an M×N array of pixels from a composite video signal, said video display system including a M×N array of movable mirrors and a plurality of piezoelectric members, each of said mirrors being mounted to a respective one of said piezoelectric members, each of said mirrors being movable by said respective one of said piezoelectric members to effect modulation of light intensity for a corresponding one of said pixels, each of said piezoelectric members forming a capacitor, $C_{ij}$, wherein $1 \leqq i \leqq M$ and $1 \leqq j \leqq N$, said composite video signal including a luminance signal, a horizontal sync signal and a vertical sync signal, said switch matrix comprising:

a pixel clock to develop a first clock signal having a plurality of first clock pulses occurring at a rate commensurately with a scan rate of said pixels;

a plurality of switch cells, $S_{ij}$;

a first counter having a clock input, a reset input, at least N first outputs and a second output, said clock input being electrically coupled to said pixel clock to have said first clock signal applied thereto, said reset input being adapted to have said horizontal sync signal applied thereto, a $j^{th}$ one of said first outputs being coupled electrically to a respective one of said switch cells, $S_{ij}$, said $j^{th}$ one of said first outputs having a first logic state upon occurrence of a $j^{th}$ clock pulse of said first clock pulses subsequent to a sync pulse of said horizontal sync signal, each other of said first outputs having a second logic state at said $j^{th}$ clock pulse, said second output developing a second clock signal having a plurality of second clock pulses, each of said second clock pulses occurring when a first one (j=1) of said first outputs is at said first logic state; and a second counter having a clock input, a reset input and at least M outputs, said clock input of said second counter being electrically coupled to said second output of said first counter to apply said second clock signal thereto, said reset input of said second counter being adapted to have said vertical sync signal applied thereto, an $i^{th}$ one of said M outputs being coupled electrically to a respective one of said switch cells, $S_{ij}$, said $i^{th}$ one of said M outputs having said first logic state upon occurrence of an $i^{th}$ clock pulse of said second clock pulse subsequent to a sync pulse of said vertical sync signal, each other of said M outputs having said second logic state at said $i^{th}$ clock pulse;

each of said switch cells, $S_{ij}$, being adapted to apply said luminance signal to a respective one of said capacitors, $C_{ij}$, when each of said $i^{th}$ one of said M outputs and said $j^{th}$ one of said N outputs has said first logic state.

7. An electronic switch matrix as set forth in claim 6 further comprising:

a high voltage, high speed linear amplifier having an input adapted to have said luminance signal applied thereto and an output electrically coupled to each of said switch cells, $S_{ij}$.

8. An electronic switch matrix as set forth in claim 6 wherein each of said switch cells, $S_{ij}$, includes:

a normally open switch adapted to be coupled electrically to said respective one of said capacitors $C_{ij}$; and an AND logic circuit having a first input electrically coupled to said $i^{th}$ one of said M outputs, a second input electrically coupled to said $j^{th}$ one of said N outputs, and an output, said output of said logic circuit normally being at said second logic state and being at said first logic state when each of said $i^{th}$ one of said M outputs and said $j^{th}$ one of said N outputs is at said first logic state, said switch closing in response to said output of said logic circuit being at said first logic state to apply said luminance signal to said respective one of said capacitors, $C_{ij}$.

9. An electronic switch matrix as set forth in claim 6 wherein each of said switch cells, $S_{ij}$, includes:

a p-channel MOSFET having a source, a drain and a gate, said source being adapted to have said luminance signal applied thereto, said drain being adapted to be coupled electrically to a respective one of said capacitors, $C_{ij}$;

a resistor;

a first n-channel MOSFET having a source, a drain and a gate, said resistor being electrically coupled to said drain of said first n-channel MOSFET to resistively couple said luminance signal to said drain of said first n-channel MOSFET, said gate of said first n-channel MOSFET being electrically coupled to said $i^{th}$ one of said M outputs, said gate of said p-channel MOSFET being electrically coupled to said drain of said first n-channel MOSFET; and a second n-channel MOSFET having a source, a drain and a gate, said drain of said second n-channel MOSFET being electrically coupled to said source of said first n-channel MOSFET, said source of said second n-channel MOSFET being adapted to be coupled to ground potential, said gate of said second n-channel MOSFET being electrically coupled to said $j^{th}$ one of said N outputs.

10. An electronic switch matrix as set forth in claim 6 wherein said first logic state is an electrical signal commensurate with a binary 1 and said second logic state is an electrical signal commensurate with a binary 0.

* * * * *